US008621825B2

(12) United States Patent
Schmied et al.

(10) Patent No.: US 8,621,825 B2
(45) Date of Patent: Jan. 7, 2014

(54) CAPSULE SUPPORT ARRANGEMENT FOR FILLING AND CLOSING MACHINES

(75) Inventors: Ralf Schmied, Freiberg (DE); Tobias Fritz, Auenwald (DE)

(73) Assignee: Robert Bosch GmbH, Stuttgart (DE)

( * ) Notice: Subject to any disclaimer, the term of this patent is extended or adjusted under 35 U.S.C. 154(b) by 542 days.

(21) Appl. No.: 12/921,860

(22) PCT Filed: Jan. 23, 2009

(86) PCT No.: PCT/EP2009/050753

§ 371 (c)(1),
(2), (4) Date: Oct. 13, 2010

(87) PCT Pub. No.: WO2009/112300

PCT Pub. Date: Sep. 17, 2009

(65) Prior Publication Data

US 2011/0016826 A1 Jan. 27, 2011

(30) Foreign Application Priority Data

Mar. 10, 2008 (DE) ..... 10 2008 013 403

(51) Int. Cl.
*B65B 5/08* (2006.01)

(52) U.S. Cl.
USPC ..... 53/281; 53/560; 53/504; 53/244

(58) Field of Classification Search
USPC ..... 53/244, 281, 471, 504, 560
See application file for complete search history.

(56) References Cited

U.S. PATENT DOCUMENTS

| | | | | |
|---|---|---|---|---|
| 2,679,965 | A | 6/1954 | Kastrin et al. | |
| 2,680,548 | A | 6/1954 | Karos | |
| 4,089,152 | A * | 5/1978 | Zanasi | 53/281 |
| 4,204,951 | A * | 5/1980 | Moser et al. | 209/625 |
| 4,615,165 | A * | 10/1986 | Gamberini | 53/282 |
| 4,731,979 | A * | 3/1988 | Yamamoto et al. | 53/529 |
| 4,884,602 | A * | 12/1989 | Yamamoto et al. | 141/242 |
| 4,940,499 | A | 7/1990 | Lebrun et al. | |
| 4,964,262 | A * | 10/1990 | Moser et al. | 53/506 |
| 5,018,335 | A | 5/1991 | Yamamoto et al. | |
| 5,321,932 | A | 6/1994 | Sundberg | |
| 5,417,030 | A * | 5/1995 | Ribani et al. | 53/281 |
| 5,966,910 | A * | 10/1999 | Ribani et al. | 53/560 |
| 6,170,226 | B1 * | 1/2001 | Chang | 53/64 |
| 6,327,835 | B1 * | 12/2001 | Trebbi | 53/53 |
| 6,367,228 | B1 * | 4/2002 | Wurst et al. | 53/381.4 |

(Continued)

FOREIGN PATENT DOCUMENTS

| | | |
|---|---|---|
| DE | 3726161 A1 | 2/1989 |
| DE | 19649716 C1 | 4/1998 |

(Continued)

*Primary Examiner* — Hemant M Desai
*Assistant Examiner* — Gloria R Weeks
(74) *Attorney, Agent, or Firm* — Michael Best & Friedrich LLP

(57) ABSTRACT

The present invention relates to a capsule support arrangement for a filling and closing machine for two-part capsules with a capsule upper part and a capsule lower part. The capsule support arrangement includes an upper part segment for receiving capsule upper parts and a lower part segment for receiving capsule lower parts. The upper part segment and the lower part segment respectively have at least one first receiving opening with a first diameter and a second receiving opening with a second diameter, the first diameter differing from the second diameter.

14 Claims, 2 Drawing Sheets

(56) References Cited

U.S. PATENT DOCUMENTS

| | | | | |
|---|---|---|---|---|
| 6,434,911 | B1 * | 8/2002 | Yamamoto et al. | 53/53 |
| 6,499,279 | B1 * | 12/2002 | Yamamoto et al. | 53/560 |
| 6,539,686 | B1 * | 4/2003 | Trebbi | 53/53 |
| 2002/0170266 | A1 * | 11/2002 | Yamamoto et al. | 53/53 |
| 2007/0044433 | A1 * | 3/2007 | Runft et al. | 53/281 |
| 2008/0236106 | A1 * | 10/2008 | Trebbi et al. | 53/471 |
| 2010/0132313 | A1 * | 6/2010 | Trebbi | 53/471 |
| 2011/0088355 | A1 * | 4/2011 | Fulper | 53/428 |

FOREIGN PATENT DOCUMENTS

| | | | |
|---|---|---|---|
| DE | 19922228 | A1 | 9/2000 |
| DE | 102004004357 | A1 | 8/2005 |
| EP | 0615739 | A1 | 9/1994 |

* cited by examiner

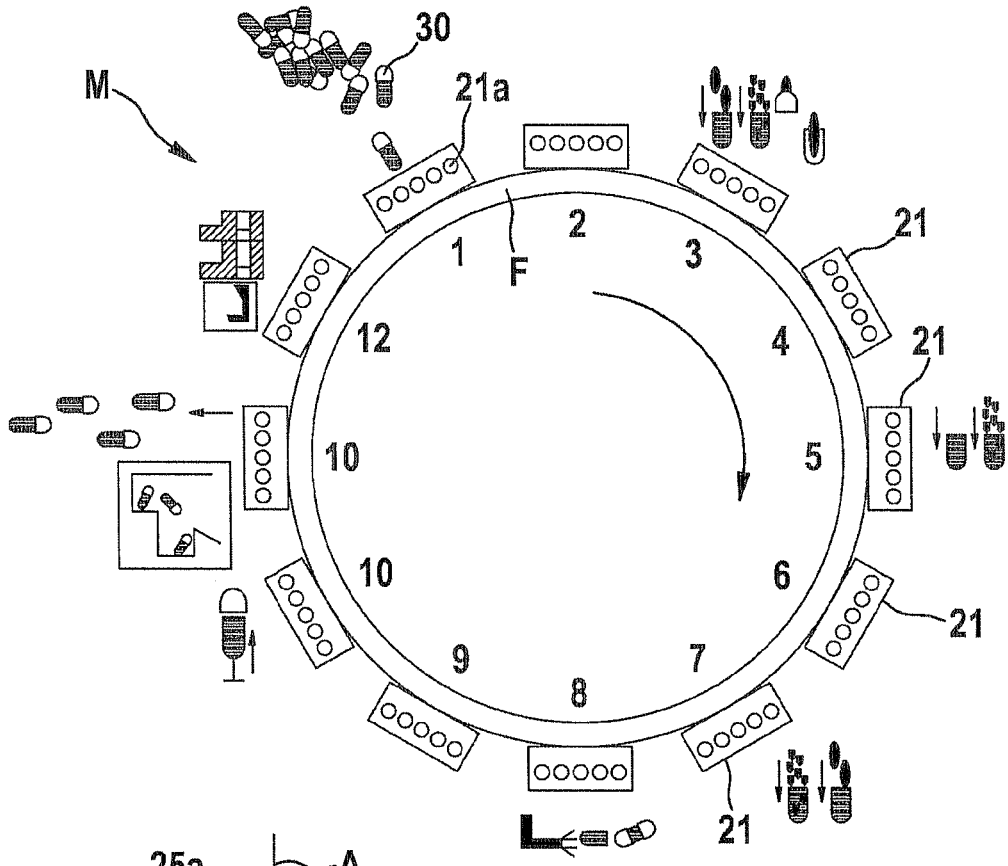
Fig. 1
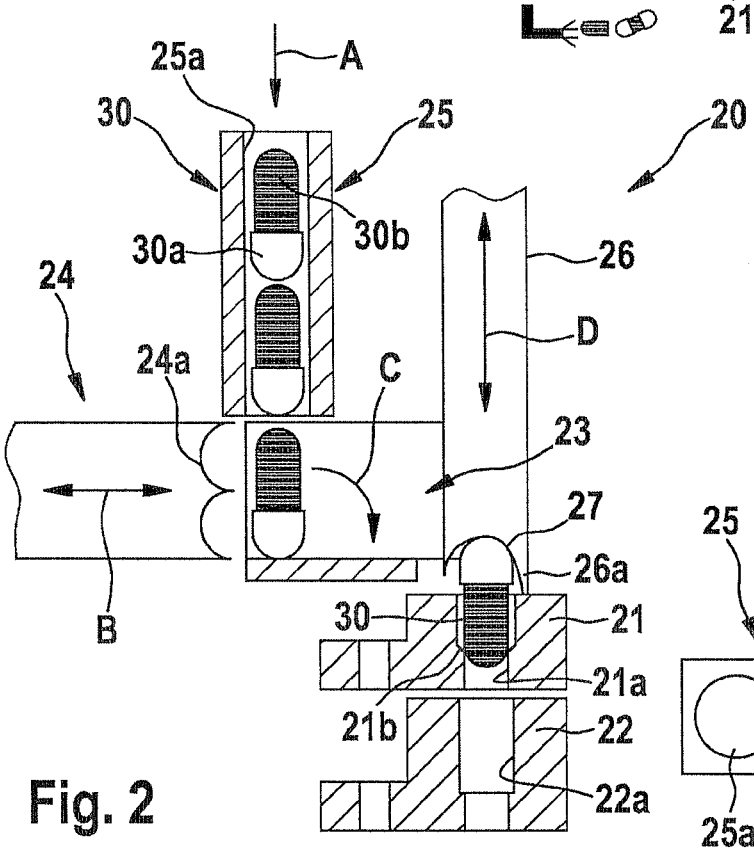
Fig. 2
Fig. 3
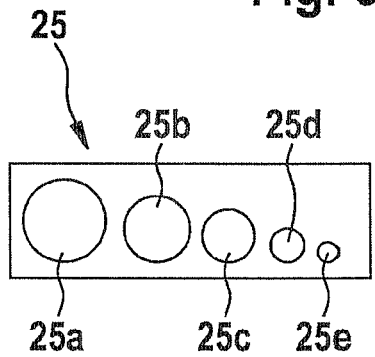

CAPSULE SUPPORT ARRANGEMENT FOR FILLING AND CLOSING MACHINES

CROSS-REFERENCE TO RELATED APPLICATION

This application is a 35 USC 371 application of PCT/EP2009/050753 filed on Jan. 23, 2009.

BACKGROUND OF THE INVENTION

1. Field of the Invention

The present invention relates to a capsule support arrangement for a filling and closing machine, in particular for medical applications.

2. Description of the Prior Art

Filling and closing machines are known, for instance from pharmaceutical applications, in which capsules in which an upper capsule part is slipped onto a lower capsule part are filled, for instance with a medication. The capsules are delivered empty and are then filled and closed incrementally at a plurality of stations on a conveyor wheel. At the various stations, quality and intactness tests can then for instance be performed. The known machines have fundamentally proven themselves over time. In laboratory areas, however, there are applications in which the known machines cannot be used in a targeted way, since the known machines are designed for the highest possible throughput. In the laboratory field, however, it is often necessary to fill only a small batch of capsules of a certain size. Although it is fundamentally possible to retrofit known machines, so that instead of one capsule size a different capsule size can be filled, nevertheless such retrofitting is very complicated and expensive. For the conveyor wheel in particular, many different capsule support arrangements have to be replaced in order to make conveying possible.

ADVANTAGES AND SUMMARY OF THE INVENTION

The capsule support arrangement according to the invention has the advantage over the prior art of furnishing a simple, economical embodiment, particularly for filling and closing machines of capsules in laboratory areas. According to the invention, in particular a fast change of capsule sizes can be achieved without problems and in a simple way. Moreover, by means of the capsule support arrangement of the invention, simple retrofitting of already existing filling machines can also be done. This is attained according to the invention by providing that the capsule support arrangement has an upper part segment and a lower part segment. The upper part segment and the lower part segment each have at least one first receiving opening with a first diameter and one second receiving opening with a second diameter. The diameters of the two receiving openings are different. As a result, it is possible, once a filling operation has been completed, for a further filling operation to be performed immediately for capsules of a different diameter.

Also preferably, the capsule support arrangement has a delivery magazine, again with at least one first receiving opening with a first diameter and one second receiving opening with a second diameter. The first diameter of the delivery magazine corresponds to the first diameter of the upper part segment, and the second diameter corresponds to the second diameter of the upper part segment. The lower part segments each have somewhat smaller diameters than the upper part segments.

Also preferably, the upper part segment, the lower part segment, and the delivery magazine have at least five receiving openings with different diameters. As a result, a filling machine can be designed for filling five different capsule sizes.

Preferably, the capsule support arrangement further includes a sorter with curved contact faces, which are adapted to various capsule lengths.

Also preferably, the capsule support arrangement has a sorting block with recesses for different capsule sizes.

Also preferably, the capsule support arrangement includes an insertion unit with a plurality of insertion punches, which each have a curved contact face. By means of the insertion punch, a capsule can be transferred or inserted into an upper part segment. The insertion punches with the curved contact faces each have radii which correspond to the radii of the associated receiving openings. As a result, a secure transfer of the capsules to the upper part segments or lower part segments is achieved. Further conveyance of a lower part of the capsules is achieved preferably by means of underpressure or a vacuum, in order to transfer a lower capsule part into the lower part segment.

Preferably, for each of the receiving openings one closure element is provided, for closing the individual receiving openings. As a result it is ensured that a capsule to be filled will not mistakenly be delivered to a receiving opening with the wrong diameter.

The invention furthermore relates to a filling and closing machine for capsules having a capsule support arrangement of the invention. The filling and closing machine is preferably used in laboratory areas for pharmaceutical applications. In particular, it is possible for small batches of capsules to be filled with a medication, as is necessary for instance in pharmaceutical development laboratories or in research facilities.

BRIEF DESCRIPTION OF THE DRAWINGS

One preferred exemplary embodiment of the invention will be described below in detail, in conjunction with the accompanying drawings. In the drawings:

FIG. 1 is a schematic top view on a filling and closing machine in accordance with an exemplary embodiment of the invention;

FIG. 2 is a schematic sectional view of a capsule support arrangement in an exemplary embodiment of the invention;

FIG. 3 is a schematic top view on a delivery magazine of the capsule support arrangement shown in FIG. 2.

DESCRIPTION OF THE PREFERRED EMBODIMENT

Figure 4:
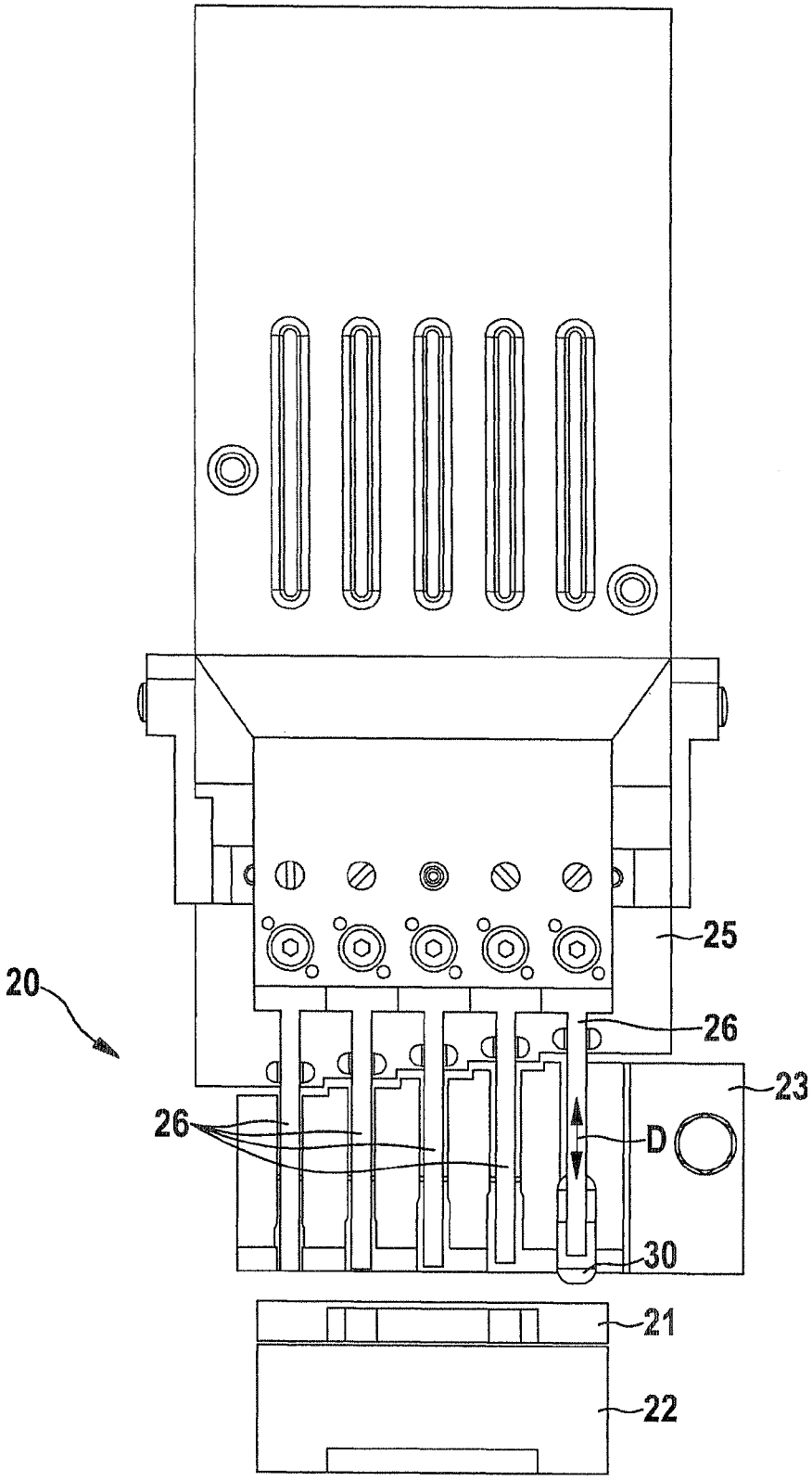
FIG. 4 is a schematic side view of the capsule support arrangement of FIG. 2.

Below, in conjunction with FIGS. 1 through 4, a capsule support arrangement 20 and a machine M for filling and closing capsules 30 will be described.

FIG. 1 shows the schematic layout of the filling and closing machine M; the machine includes a rotatable conveyor wheel F, on which stations 1 through 12 are disposed along the path of revolution of the conveyor wheel. At 1, the empty capsules that are to be filled are taken from a reservoir and aligned and delivered to the machine In the process the capsules are separated, so that an upper part and a lower part of the capsules are disposed separately. At station 3, station 5, and station 7, filling stations are provided in which the lower parts of the capsules can be filled. Station 8 is a station for detecting flaws; defective capsules are rejected. Closure of the capsules is done in station 10, and ejection is done in station 11. Station 12 is a cleaning station. It should be noted that the machine may provide still other stations, particularly for checking the fill level of the capsules, closure security, and so forth.

In FIG. 1, twelve upper part segments 21 are schematically shown, which each have five recesses 21*a*. The five recesses 21 a each have different diameters, so that each can receive only one predetermined capsule size. FIG. 2 schematically shows the capsule support arrangement 20. As can be seen from FIG. 2, the capsule support arrangement 20 includes an upper part segment 21, a lower part segment 22, a sorting block 23, a sorting rake 24, and a delivery magazine 25. An insertion unit with a plurality of insertion punches 26 disposed parallel to and next to one another is also provided.

FIG. 3 schematically shows a top view on the delivery magazine 25. As can be seen in FIG. 3, the delivery magazine 25 has five recesses 25*a*, 25*b*, 25*c*, 25*d* and 25*e*, which each have different diameters. The diameters are selected such that each recess can receive precisely one capsule diameter. The capsules 30 are delivered from a reservoir, not shown, in which they are disposed in random order. The capsules 30 are closed and include an upper part 30*a* and a lower part 30*b*. Each of the insertion punches 26 includes a curved contact face 27, for inserting a capsule into an upper part segment 21.

The function of the capsule support arrangement 20 of the invention is as follows. In the first step, the random capsules are delivered from the reservoir to the delivery magazine 25, which is indicated in FIG. 2 by the arrow A. The delivery magazine 25 includes five recesses 25a-25e, which are each closable by means of a closing element, not shown. If the capsule having the largest diameter is to be filled, however, it is possible to dispense with the closing elements, since because of their large diameter the capsules do not fit into the other recesses 25*b*-25*e*.

The delivery magazine 25 is disposed movably in the vertical direction, so that it can always be moved into the reservoir at certain time intervals in order to separate capsules 30.

As can be seen from FIG. 2, the capsules 30 from the delivery magazine 25 reach a sorting block 23. In the sorting block 23, the delivered capsules are aligned, being rotated by 90° by means of the sorting rake 24, so that they are arranged lying horizontally. This is indicated in FIG. 2 by the arrow C. As indicated by the double arrow B, the sorting rake 24 can be moved back and forth in the horizontal direction and by means of a protruding tip 24*a*, it can rotate the capsules by 90° in the appropriate direction. The sorting rake 24 has curved contact faces and is adapted to the particular capsule length. Once the capsule 30 has been rotated, the sorting rake 24 thrusts the capsules in FIG. 2 to the right beneath one of the insertion punches 26. Each insertion punch 26 is movable in the vertical direction, as indicated by the double arrow D. The insertion punch 26 has a protruding region 26*a*, which comes into contact first with the capsule 30. As a result, the capsule 30 is rotated once again by 90°, in such a way that the upper part 30*a* of the capsule 30 comes into contact with the curved contact face 27. The insertion punch 26 is then moved farther downward, until the capsule 30 is positioned entirely inside the upper part segment 21. The upper part segment 21 has five recesses 21*a*, which are embodied as stepped bores in such a way that the upper part 30*a* rests on the shoulder 21*b* of the stepped bore and thus cannot be pushed any farther downward in the vertical direction. Once the capsule 30 is disposed in the upper part segment 21 in this way, the lower part 30*b* of the capsule 30 is aspirated by means of underpressure, so that the lower part 30*b* is disposed in a stepped bore 22*a* of the lower part segment 22. A smaller diameter of the stepped bore 22*a* is selected, such that the lower part 30*b* is not aspirated through it. As a result, the capsule 30 is opened, so that in the following stations checking for damage and filling of the capsules can be done.

If a different batch of capsules is now to be filled, then according to the invention there is no need to replace the upper part segment, lower part segment, delivery magazine, sorting rake 24, or sorting block 23. Care must merely be taken at the delivery magazine 25 to ensure that those recesses 25*a*-25*e* that do not correspond to the diameter of the capsules to be filled are closed. For instance, if now only very small capsules are to be filled, then the recesses 25*a*-25*d* are closed, and only the recess 25*e* in the delivery magazine 25 stays open. It is thus prevented that the small capsules 30 will be introduced into the wrong recess and capsules will be delivered to the sorting block 23 only via the recess 25*e*. It should be noted that a separate insertion punch 26 is provided at the sorting block 23 for every diameter of the capsules, the insertion punch being adapted especially to those capsules. This can be seen in FIG. 4, in which the insertion punches 26 are arranged next to one another in a row corresponding to the opening diameters of the delivery magazine 25 and the upper part segment 21. In addition, the sorting block 23 also has recesses for various capsule sizes.

Thus the machine according to the invention is especially well suited to use in a laboratory, in which only small batches, for instance for sampling purposes, have to be filled and in which many capsules of different sizes have to be manipulated. Then a complicated conversion of the machine is unnecessary, and furthermore there is no need to keep an inventory on hand for various format sets relating to the delivery magazine, the sorting rake, the sorting block, the upper part segments, and the lower part segments. Of the multiple capsule passages through the machine present in the exemplary embodiment, only one at a time is used, depending on the capsule size, and the others are prevented from being used, for instance by means of coverings.

The foregoing relates to the preferred exemplary embodiment of the invention, it being understood that other variants and embodiments thereof are possible within the spirit and scope of the invention, the latter being defined by the appended claims.

The invention claimed is:

1. A capsule support arrangement for a filling and closing machine for two-part capsules having an upper capsule part and a lower capsule part, including an upper part segment for receiving upper capsule parts and a lower part segment for receiving lower capsule parts, the upper part segment and the lower part segment each having at least one first receiving opening with a first diameter and at least one second receiving opening with a second diameter, wherein the first diameter differs from the second diameter, the capsule support arrangement further including a delivery magazine having at least one first receiving opening with a first diameter and one second receiving opening with a second diameter, the first diameter of the delivery magazine different than the second diameter of the delivery magazine, the first receiving opening of the delivery magazine being spaced apart from the second receiving opening of the delivery magazine along the delivery magazine, wherein the diameter of the first receiving opening of the delivery magazine is equivalent to the diameter of the first receiving opening of the upper part segment, and wherein the diameter of the second receiving opening of the delivery magazine is equivalent to the diameter of the second receiving opening of the upper part segment.

2. The capsule support arrangement as defined by claim 1, wherein the lower part segment, the upper part segment, and the delivery magazine each have at least five receiving openings with different diameters.

3. The capsule support arrangement as defined by claim 2, further including a sorting rake with curved contact faces, which are adapted to various capsule lengths.

4. The capsule support arrangement as defined by claim 2, further including a sorting block with recesses for various capsule sizes.

5. The capsule support arrangement as defined by claim 2, further including an insertion unit having a plurality of insertion punches with curved contact faces, for inserting a capsule into the upper part segment, wherein a radius of a curved contact face is equivalent to a radius of an associated receiving opening of the upper part segment.

6. The capsule support arrangement as defined by claim 1, further including a sorting rake with curved contact faces, which are adapted to various capsule lengths.

7. The capsule support arrangement as defined by claim 6, further including a sorting block with recesses for various capsule sizes.

8. The capsule support arrangement as defined by claim 6, further including an insertion unit having a plurality of insertion punches with curved contact faces, for inserting a capsule into the upper part segment, wherein a radius of a curved contact face is equivalent to a radius of an associated receiving opening of the upper part segment.

9. The capsule support arrangement as defined by claim 1, further including a sorting block with recesses for various capsule sizes.

10. The capsule support arrangement as defined by claim 9, further including an insertion unit having a plurality of insertion punches with curved contact faces, for inserting a capsule into the upper part segment, wherein a radius of a curved contact face is equivalent to a radius of an associated receiving opening of the upper part segment.

11. The capsule support arrangement as defined by claim 1, further including an insertion unit having a plurality of insertion punches with curved contact faces, for inserting a capsule into the upper part segment, wherein a radius of a curved contact face is equivalent to a radius of an associated receiving opening of the upper part segment.

12. A filling and closing machine for capsules, including a capsule support arrangement as defined by claim 1.

13. The capsule support arrangement as defined by claim 1, wherein the first receiving opening of the upper part segment is part of a first stepped bore in the upper part segment, and the second receiving opening of the upper part segment is part of a second stepped bore in the upper part segment.

14. The capsule support arrangement as defined by claim 1, wherein the first receiving opening of the lower part segment is part of a first stepped bore in the lower part segment, and the second receiving opening of the lower part segment is part of a second stepped bore in the lower part segment.

* * * * *

UNITED STATES PATENT AND TRADEMARK OFFICE

CERTIFICATE OF CORRECTION

PATENT NO. : 8,621,825 B2
APPLICATION NO. : 12/921860
DATED : January 7, 2014
INVENTOR(S) : Schmied et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 577 days.

Signed and Sealed this
Twenty-second Day of September, 2015

Michelle K. Lee

Michelle K. Lee
*Director of the United States Patent and Trademark Office*